US008308345B2

(12) United States Patent
Jolidon

(10) Patent No.: US 8,308,345 B2
(45) **Date of Patent: *Nov. 13, 2012**

(54) DEVICE COMPRISING A CLOCK MOVEMENT AND A CHRONOGRAPH MODULE

(75) Inventor: Hugues Jolidon, Courfaivre (CH)

(73) Assignee: LVMH Swiss Manufactures SA, La Chaux-de Fonds (CH)

( * ) Notice: Subject to any disclaimer, the term of this patent is extended or adjusted under 35 U.S.C. 154(b) by 0 days.

This patent is subject to a terminal disclaimer.

(21) Appl. No.: 13/047,228

(22) Filed: Mar. 14, 2011

(65) Prior Publication Data

US 2011/0164474 A1 Jul. 7, 2011

Related U.S. Application Data

(63) Continuation of application No. 10/899,713, filed on Jul. 27, 2004, now Pat. No. 7,905,655, which is a continuation of application No. PCT/CH03/00063, filed on Jan. 27, 2003.

(30) Foreign Application Priority Data

Feb. 1, 2002 (EP) ..... 02405063

(51) Int. Cl.
*G04F 7/00* (2006.01)
*G04B 1/20* (2006.01)
*G04B 27/02* (2006.01)

(52) U.S. Cl. ..... 368/101; 368/106; 368/127; 368/140; 368/190

(58) Field of Classification Search ..... 368/80, 368/101–106, 124, 127, 139, 140, 169, 145, 368/190, 191, 192
See application file for complete search history.

(56) References Cited

U.S. PATENT DOCUMENTS

| | | | |
|---|---|---|---|
| 273,100 | A | 2/1883 | Karr |
| 352,326 | A | 11/1886 | Jennings |
| 379,963 | A | 3/1888 | Leonard et al. |
| 458,348 | A | 8/1891 | Bourquin |

(Continued)

FOREIGN PATENT DOCUMENTS

| | | |
|---|---|---|
| CH | 218931 | 5/1942 |

(Continued)

*Primary Examiner* — Vit W Miska
(74) *Attorney, Agent, or Firm* — Pearne & Gordon LLP

(57) ABSTRACT

A device comprises a basic clock movement MB whose time indicators are driven by a first barrel connected to a first wheelwork and a first regulator organ, and an autonomous chronograph module MCA whose indicators are driven by a second barrel independent from the first, connected to a second wheelwork and a second regulator organ. The chronograph module is exclusively composed of mechanical elements. The frequency of oscillation supplied by its regulator is equal N times the frequency of oscillation supplied by the regulator of the base movement, with the coefficient N being definable according to a specific application of the chronograph, so that any chronograph module thus previously defined can work with the same base movement. The chronograph regulator remains constantly engaged with the corresponding wheelwork. The chronograph module allows a time interval to be read with a minimum precision of a hundredth of second. The organs of the base movement and of the chronograph module are arranged in such a way that in assembled state, the height and overall diameter do not exceed 7.75 mm and 30 mm respectively, the dimensions of the chronograph itself being not greater than 4 mm (height) and 30 mm (diameter) when its elements are mounted on a bottom plate, so that the device can advantageously be integrated in the case of a wrist-watch and affords an aesthetic exterior.

10 Claims, 10 Drawing Sheets

U.S. PATENT DOCUMENTS

| | | | |
|---|---|---|---|
| 690,721 | A | 1/1902 | Goldfaden |
| 2,372,771 | A | 4/1945 | Drescher |
| 2,598,701 | A | 6/1952 | Kaufmann |
| 2,675,667 | A | 4/1954 | Schlenker |
| 2,777,281 | A | 1/1957 | Berry |
| 2,969,636 | A | 1/1961 | Batori et al. |
| 3,323,303 | A | 6/1967 | Jaccard |
| 3,408,810 | A | 11/1968 | Meitinger |
| 3,479,813 | A | 11/1969 | Kocher |
| 3,568,432 | A | 3/1971 | Dubois et al. |
| 3,712,036 | A | 1/1973 | Morita |
| 3,733,805 | A | 5/1973 | Kashimura et al. |
| 3,739,570 | A | 6/1973 | Bachmann |
| 3,903,686 | A | 9/1975 | Burki |
| 4,122,663 | A | 10/1978 | Kock |
| 4,363,553 | A | 12/1982 | Thomi et al. |
| 4,748,603 | A | 5/1988 | Ray et al. |
| 5,113,382 | A | 5/1992 | Bron |
| 5,220,541 | A | 6/1993 | Vuilleumier |
| 5,278,807 | A | 1/1994 | Mathys |
| 5,793,708 | A | 8/1998 | Schmidt et al. |
| 6,166,999 | A * | 12/2000 | Jujo et al. ..... 368/66 |
| 6,406,176 | B1 | 6/2002 | Takahashi et al. |
| 6,761,478 | B2 | 7/2004 | Schmiedchen et al. |
| 6,939,034 | B2 | 9/2005 | Dubois |
| 7,192,181 | B2 | 3/2007 | Schmiedchen |
| 7,905,655 | B2 * | 3/2011 | Jolidon ..... 368/101 |
| 2007/0041277 | A1 | 2/2007 | Gerber et al. |

FOREIGN PATENT DOCUMENTS

| | | | |
|---|---|---|---|
| DE | 19610051 | A1 | 9/1997 |
| EP | 0335054 | | 10/1989 |
| EP | 0620509 | A1 | 10/1994 |
| EP | 0806712 | A2 | 11/1997 |
| EP | 1024416 | A2 | 8/2000 |
| EP | 1043636 | A1 | 10/2000 |
| EP | 1115040 | A1 | 7/2001 |
| GB | 2267587 | A | 8/1993 |
| JP | 410073671 | A | 3/1998 |
| WO | 9858299 | | 12/1998 |

* cited by examiner

DEVICE COMPRISING A CLOCK MOVEMENT AND A CHRONOGRAPH MODULE

REFERENCE DATA

This application is a continuation of U.S. patent application Ser. No. 10/899,713 filed on Jul. 27, 2004, which is a continuation of international PCT application PCT/CH03/00063 (WO03/065130) filed on Jan. 27, 2003, claiming priority of European patent application EP02405063.5 filed on Feb. 1, 2002, the contents whereof are hereby incorporated.

FIELD OF THE INVENTION

The present invention concerns a device comprising a usual clock movement and a chronograph module according to the preamble of the independent claim 1.

DESCRIPTION OF RELATED ART

The market of chronograph watches equipped with a device of this kind has developed considerably during the past years, in particular in the up-market segment. However, a very large proportion of such watches comprise a chronograph plate (hereafter called indifferently chronograph part, module or movement) having a quartz oscillator, whilst a certain clientele feels increasingly attracted to mechanical chronograph watches. With the latter, however, and for reasons that will be explained below, the one skilled in the art encounters notably a problem as regards the precision (also called resolution) of reading.

Wrist-watches whose case holds a chronograph module or movement equipped with a quartz oscillator enable the wearer to perform measurements of a precision that depends on the type of display, namely on the order of the tenth or of the hundredth of second, according to whether this display is analog or digital respectively.

CH-667,771 describes a chronograph watch comprising a common central clock movement driving the hour, minute and seconds hands and an autonomous chronograph movement presenting a timekeeper and at least one indicator driven by an electric motor. The organs of the chronograph movement are arranged at the periphery of the usual movement or of the base movement. Each movement comprises its own regulator oscillating at the same frequency as the other. The chronograph movement is provided with an independent case in the shape of a bell covering the basic clock movement and encircling the latter. The two movements are connected by means of a plate interposed between them.

This construction aims at making an electric chronograph watch at low cost. On the other hand, the precision remains very questionable, the chronograph hand beating the fifth of second (which corresponds to an oscillator at 18,000 oscillations per hour). Furthermore, this document does not supply any teachings to the one skilled in the art as to the arrangement of the organs of the chronograph module or movement, supposing this module were mechanical, nor as to the cooperation between a module of this type and the usual basic clock movement.

Yet, this arrangement and cooperation gives rise to complex problems as regards reliability and execution both on the technical and on the aesthetic levels—which are not at all resolved by using a quartz chronograph but merely avoided by being circumvented—to a point where the one skilled in the art has always been dissuaded from contemplating said arrangement and said cooperation and a fortiori from assigning himself the task of realizing them.

In fact, the measurement precision of mechanical chronographs currently available on the market is, for the most part, on the order of 0.125 seconds, the corresponding balance oscillating at 28,800 oscillations per hour, and, more rarely, for certain other, considerably more expensive mechanical chronographs whose balance oscillates at 36,000 oscillations per hour, on the order of 0.1 seconds. This measurement precision cannot be increased with the mechanical chronographs having a common time base for the clock part and the chronograph part, for several reasons. The use for the clock part of a balance oscillating at a greater frequency would modify the unwinding speed of the barrel spring and would diminish the movement's power-reserve time. Furthermore, an ensemble comprising an escape wheel, pallets, an impulse-pin and a balance pivot, that would be subjected continuously to such service conditions, would show after a couple of months already considerable wear that would inevitably cause an irreversible alteration of the good running of the movement. It must also be stressed that at a high frequency, the energy transmission from the barrel to the sprung balance through the wheelwork and the escapement poses, in continuous use, problems whose solutions would most probably imply the use of complex means that would nevertheless still remain chancy. Thus, by way of example, a balance oscillating at a high frequency has a lower amplitude than the same balance oscillating at a lower frequency. Therefore, it will be more sensitive to variations of the barrel spring's driving torque and will offer running stability only during the period where the variation curve of said driving torque of the spring is linear.

Further to these difficulties are those raised by the questions of cost and aesthetics. On the one hand, it is known that a horological piece and in particular a wrist-watch housing a device comprising a basic clock movement and a fully mechanical chronograph movement is in principle classified in the top of the range. Its price is thus high whilst the precision of its chronograph movement is low and does not even achieve that of a low-market digital display quartz chronograph movement. On the other hand, the making of a horological piece housing a double movement, clock and chronograph, both mechanical, conceivably confronts the clockmaker with a delicate problem of space requirement or volume of the piece, a problem that in the absence of a solution will result in wanting aesthetics likely to compromise the commercial success of the watch. One solution that springs to mind would consist in miniaturizing the organs composing the mechanical chronograph. But although it would serve the aesthetic aspect, it would go against the aim of cost-effectiveness and would certainly raise major technical difficulties. Choosing and applying this solution would therefore not be without technical and commercial risks. These risks seem sufficiently dissuasive to invite the one skilled in the art to conceive and investigate other paths in order to realize the device with a quality to price ratio that is as advantageous as possible.

It is one aim of the invention to propose a device that palliates the inconvenience of lack of precision while ensuring furthermore a truly reliable reading whatever the characteristic of the chosen regulator, and thus of the expected precision, and excluding all aforementioned disturbances on the clock part of the device's movements.

BRIEF SUMMARY OF THE INVENTION

This aim is achieved with the means described in the independent claim 1, the dependent claims relating to means permitting preferred embodiments of the invention, furthermore at low cost, in keeping with the aforementioned quality-price ratio.

Tests performed on inventive prototypes equipped with a chronograph whose balance oscillated at 360,000 oscillations per hour made it possible to ascertain that a precision on the order of the hundredth of second was ensured even in continuous use during at least thirty minutes. In other words, the device according to the invention renders possible the making of a top-of-the-range horological piece that is truly fully mechanical, and whose chronograph precision bears comparison with a high-quality quartz chronograph.

BRIEF DESCRIPTION OF THE DRAWINGS

An embodiment of the device will be described in detail hereafter, by way of a non-limiting example, supporting the attached drawings, in which.

DETAILED DESCRIPTION OF THE INVENTION

Figure 1:
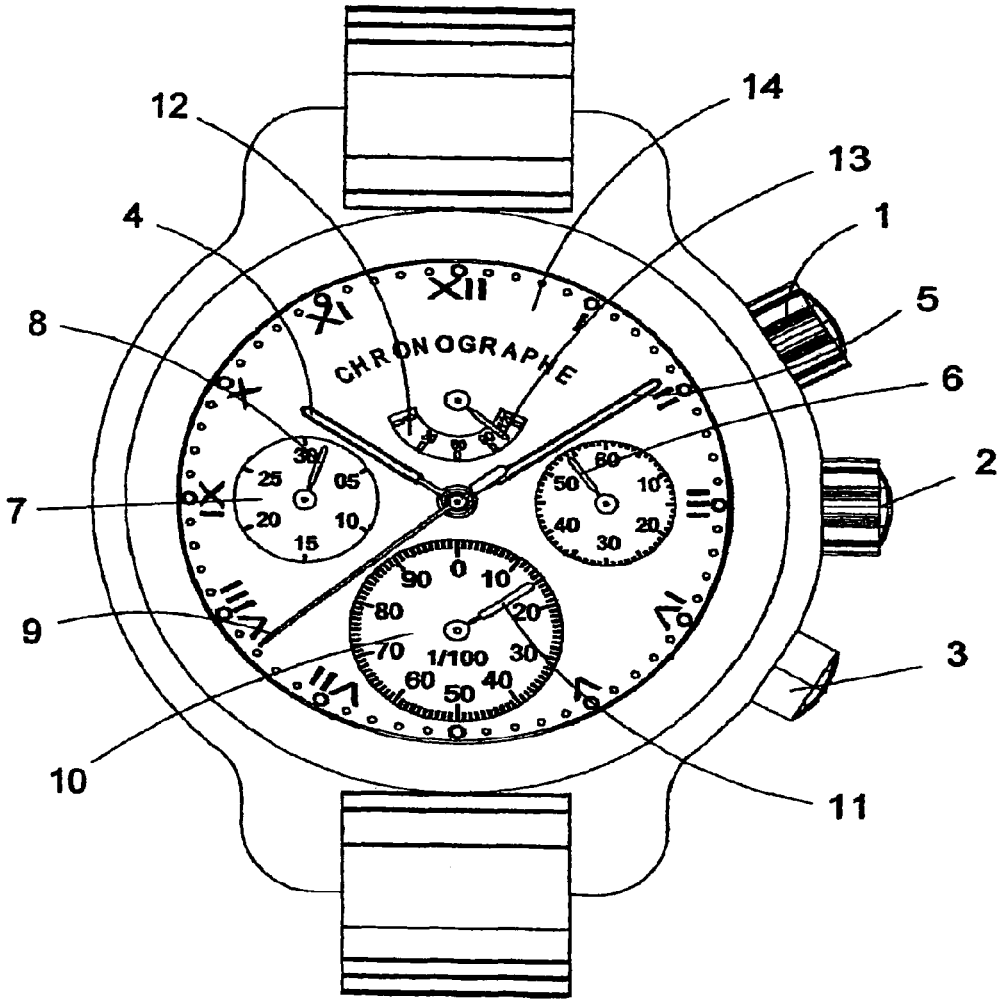
FIG. 1 shows a top view of a horological piece in the form of a wrist-watch incorporating a device according to the invention.

The device according to the invention will be applied advantageously in a chronograph wrist-watch (not specifically referenced), as represented in FIG. 1. This watch shows: at two o'clock, a push-piece winding-button (crown) 1 for winding a barrel of the device's chronograph module—hereafter called autonomous chronograph module MCA—and for commanding the starting and stopping functions of the autonomous chronograph module MCA, at three o'clock, a winding-button (crown) 2 of the device's clock movement—hereafter called base movement MB—and at 4 o'clock, a push-piece 3 actuated for the resetting to zero and for the flight returning of the autonomous chronograph module MCA. In a preferred embodiment illustrated further below in relation to FIG. 9, the watch comprises a single winding-crown allowing to simultaneously reset and rewind, in different axial positions, the base movement MB and the auxiliary chronograph module MCA.

The chronograph watch enables the displaying of the current time by means of an hour hand 5, of a minutes hand 5 and of a small seconds hand 6 placed at three o'clock. It also allows the displaying of the measurement of an elapsed time by means of a thirty minute counter 7, placed at nine o'clock at provided with a hand 8, a chronograph centre seconds hand 9 and a hundredth of second counter 10 placed at six o'clock and provided with a hand 11. A power-reserve counter 12 of the autonomous chronograph module MCA provided with a hand 12 and placed at twelve o'clock serves to verify said module's autonomy until the next winding. The graduations of these different counters are indicated on a dial 14; in particular, the hundredths of second correspond to hundred markings materialized on a circular scale, the hand 11 effecting a 360° rotation per second to ensure a comfortable and accurate reading of the time interval.

Figure 2:
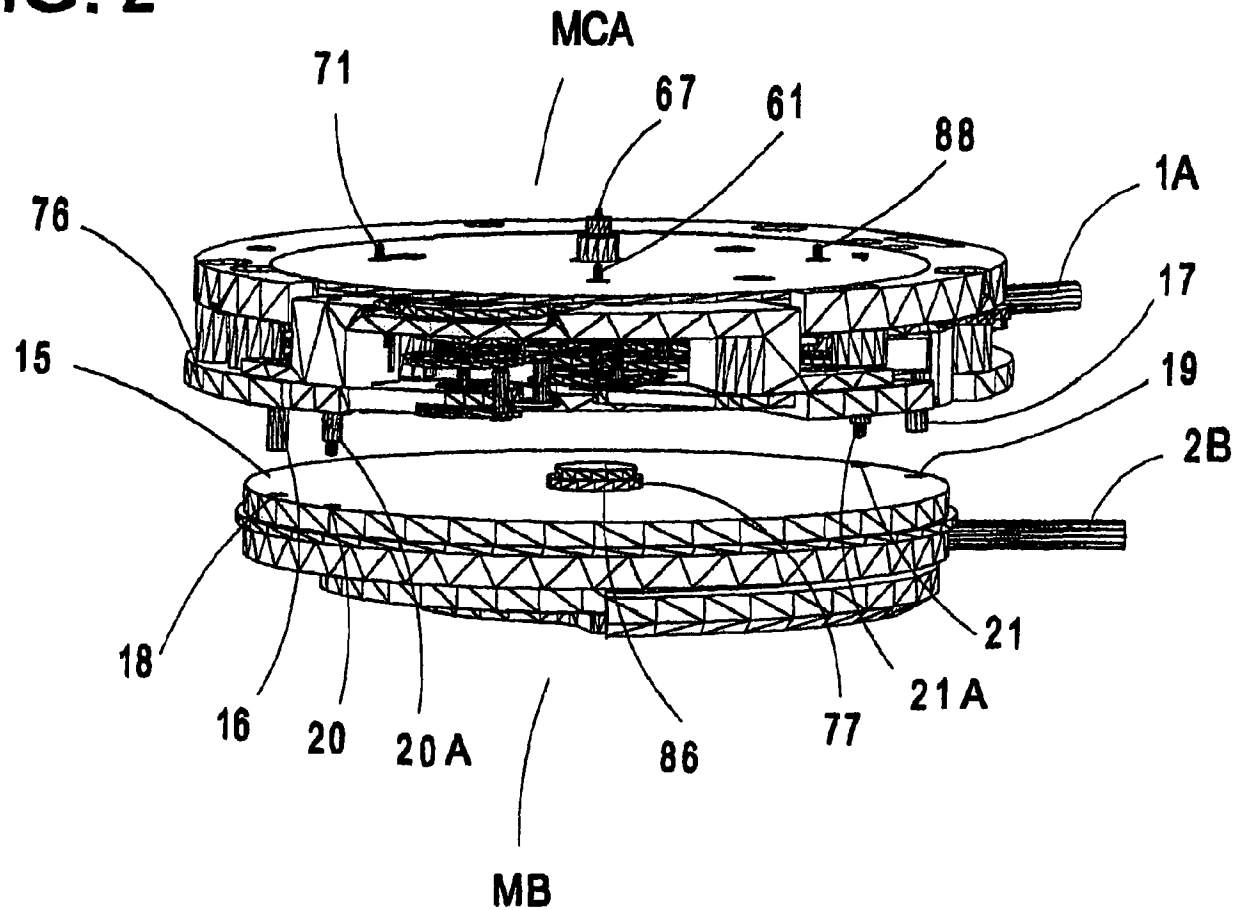
FIG. 2 shows a perspective view of the device in non-assembled state.

FIG. 2 is a perspective view showing the principle of the assembly of the autonomous chronograph module MCA with the base movement MB, centring elements and fastening organs being provided. By way of a non-limitative example, the base movement can for example be constituted by a movement of the type 2892 sold by the company ETA SA. A base plate 76 of the autonomous chronograph module MCA exhibits two holes (not visible and not referenced) in which are driven cylindrical pins 16, 17 designed to engage in dial pin holes 18, 19 of a bottom plate 15 of the base movement MB, for the purpose of a correct angular positioning of the MCA module relative to the MB movement. Fastening means connect the base movement MB and the autonomous chronograph module MCA at their periphery. According to the example, screws 20A, 21A go through holes (not visible and not referenced) provided in the plate 76 and are screwed in corresponding threaded holes 20, 21 of the bottom plate 15. Are further represented in this FIG. 2: on the one hand, on the autonomous chronograph module MCA and projecting from its flank, a push-piece stem 1A designed to receive the push-piece winding-crown 1 (FIG. 1) and, emerging from its upper side, a staff 71 of the minutes train, a staff 67 of the seconds train, a staff 61 of the hundredth of second train and a staff 88 of the small seconds hand; on the other hand, on the basic module MB and projecting from its flank, a push-piece stem 2B designed to receive the winding-crown 2 (FIG. 1) and, emerging from its upper side, in the centre, a wheel 86 of the seconds train and a wheel 77 of the minutes train. As mentioned further above, a single rewind-button (crown) could, by means of the mechanism illustrated in FIG. 9, be used to actuate axially and rotationally the two stems 1A and 1B.

Figure 3:
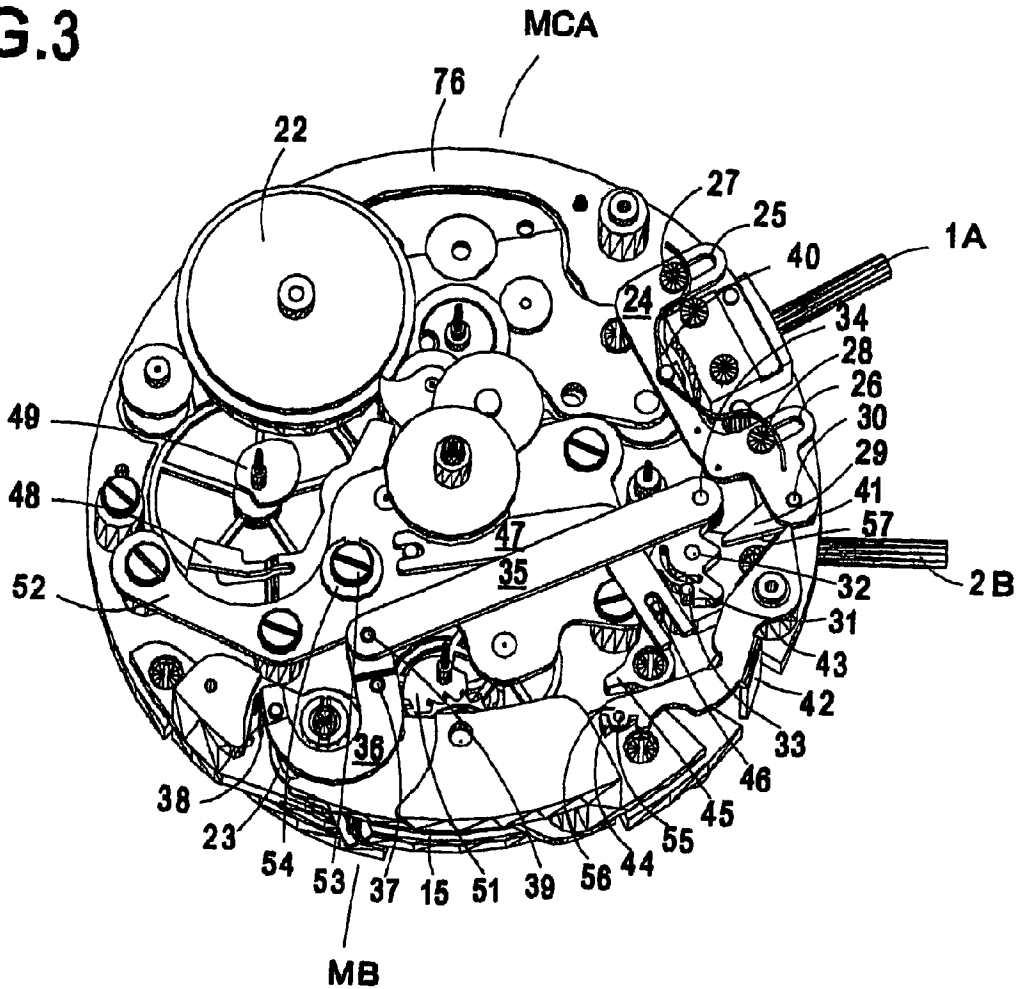
FIG. 3 shows a perspective view of only the chronograph module.

FIG. 3 is a perspective view of the two movements in assembled state, showing essentially the autonomous chronograph module MCA covering the base movement MB (visualized principally by its bottom plate 15 and its winding-crown stem 2B) and illustrating the remarkable and original arrangement and conformation of the main organs and elements of the autonomous chronograph module MCA on its base plate 76. This extremely closely packed and compact arrangement results from an optimum exploitation of the available volumes, which avoids a costly miniaturization of said organs and elements without sacrificing the aesthetics, this design and construction enabling the device's dimensions in assembled state to be reduced to extremely low values. According to the described embodiment, these values are on the order of 7.75 mm (height) and 30 mm (overall diameter), whilst the dimensions of the chronograph module MCA itself do not exceed values on the order of 4 mm (height) and 30 mm (diameter). It will be understood that these dimensions afford a wide and extremely varied choice of exteriors for the device and a remarkable and effective aesthetic.

In order to reduce even further the height of the chronograph movement, it is conceivable to place the elements—which will be discussed in more detail further below (notably regulator organs, barrels, respective wheels, power-reserve, levers, winding systems)—on bridges arranged appropriately, from a single bottom plate, with the basic and chronograph movements then overlapping each other, without preventing the chronograph module's good running according to the methods that will be described hereafter, although the manufacturing costs will be increased.

The autonomous chronograph module MCA is equipped with its own barrel 22 and its own regulator organ comprising notably a balance 23. This characteristic precludes any power take-off on the base movement MB and enables the balance 23 to be stopped without disturbing the sprung balance of the base movement MB.

The chronograph MCA is started and released by a pressing briefly on the push-piece stem 1A, i.e. on the winding-crown 1. Each of these pushing actions produces a displacement in the direction of the chronograph MCA's centre of a plate 24 comprising grooves in the shape of oblong openings 25, 26, with this displacement, which is guided by screws 27, 28 working with said grooves, simultaneously actuating a beak 29. When the pressure is released, the plate 24 and the beak 29 take their initial positions under the action respectively of a wire spring 40 and of a drawback spring 41.

From an initial position (chronograph stopped, i.e. set at zero), the extremity of the beak 29, pivoting around a pin 30, comes into contact with a flank of a central wing of a cam 31 and makes said cam 31 turn around an arbor 32 by an angle defined by a stop 33. A catch 34 then drives a lever 35, a catch 39 makes a launcher 36 pivot around its arbor 37, and a spring-blade 38 projects tangentially from the outer side of the balance 23. In so doing, the spring 38 supplies to the balance 23 a starting impulse to put it into motion. A new pressing on the winding-crown 1 leads to the stopping of the chronograph at the end of an identical but inverse process (initial position corresponding to that illustrated in FIG. 3, with the balance in motion), with the spring-blade 38 this time coming tangentially into contact with the outer side of the balance 23 and immobilizing the latter.

A pressure exerted on the push-piece 3 (FIG. 1) causes a resetting to zero of the chronograph module MCA.

Each resetting to zero is effected by actuating a single hammer 48. The aforementioned pushing action on the push-piece 3 makes a lever 42 and consequently its beak 44 pivot around a pillar staff 43, which causes a reverser 45 to be driven with its pin 46, the latter itself commanding a lever 47 that makes the hammer 48 pivot, which causes the hammer's three beaks (not referenced) to drop onto cams (heart-pieces) 49, 50, 51 mounted on the mobiles of the minutes counter, of the seconds counter and of the hundredth of second counter (see also FIG. 4) and thus causes the resetting to zero of the chronograph module MCA.

When the lever 42 is pushed, the beak 44 remains in contact with the reverser 45 during approximately two thirds of the angular space described by the lever 42 around the pillar staff 43, then said beak 44 separates tangentially from the extremity of the reverser 45 and the latter returns to its initial position under the action of a drawback spring wound around the pivoting axis of said reverser 45 (in FIG. 3, neither this drawback spring nor this pivoting axis are referenced, the pivoting axis being moreover hidden by the reverser 45).

The hammer 48 is fastened to the wheelwork bridge 52 by a screw 53 and an eccentric washer 54. The eccentric washer 54 enables the regulation of the hammer 48 to be adjusted so that the three beaks of said hammer 48 press simultaneously on the three heart-pieces 49, 50 and 51, the resetting to zero of the chronograph module MCA being thus performed just before the beak 44 leaves the reverser 45.

The consequences during the resetting to zero of the chronograph module MCA differ according to whether the balance 23 is stopped or moving.

If the balance 23 is stopped, the spring-blade 38 is in contact with the balance 23 and the friction exerted by the staffs 61, 67, 71 (FIGS. 2 and 4) on the wheelwork has no influence on the balance 23.

On the other hand, if the balance is moving, the spring-blade 38 is not in contact with the balance 23 and the friction exerted by the staffs 61, 67 and 71 on the wheelwork will tend to brake the balance 23.

When the pressure on the lever 42 is released, the beak 44, held by a drawback spring 56, can pivot around a pin 55 to avoid the reverser 45 and enable the lever 42 to take back its initial resting position under the action of a drawback spring 57.

The operating principle described here above thus serves to prevent said balance to stop because of a prolonged friction of the staffs 61, 67 and 71 when the autonomous chronograph module MCA is reset at zero with the balance 23 being in motion.

Thus, a same pressure exerted on the push-piece 3 (FIG. 1) causes a resetting to zero of the chronograph module MCA when the balance 23 is stopped, and a resetting to zero of the chronograph module MCA (operation called flight returning) followed by an automatic restarting of a new measurement (without obligation to push again the push-piece stem 1A) when the balance 23 is in motion.

The sprung balance ensemble of the chronograph's regulator organ is stopped when the latter is not in use.

Figure 4:
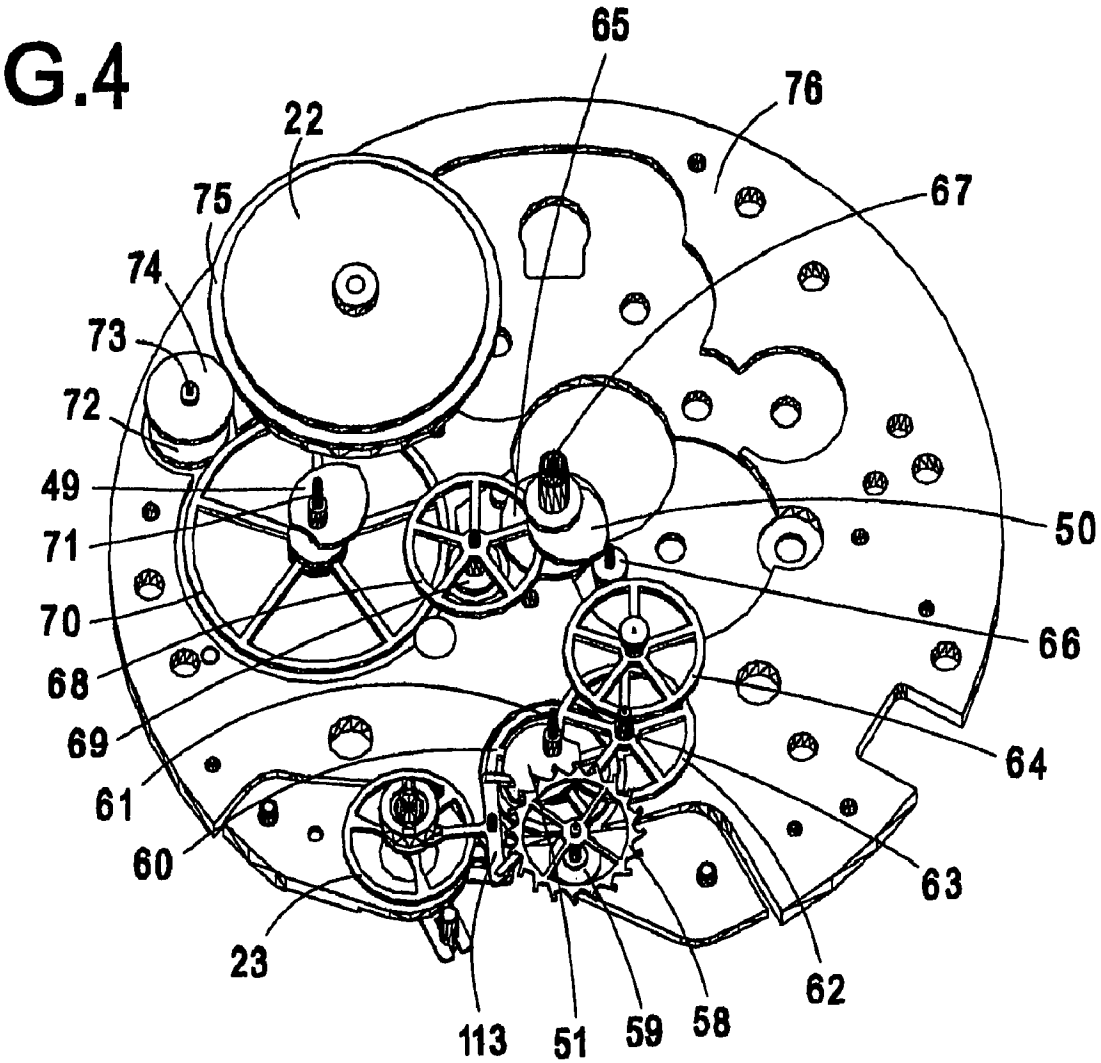
FIG. 4 shows a perspective representation of the regulator organ, of the wheelwork and of the barrel of the chronograph module.

FIG. 4 is a perspective view illustrating the arrangement of the regulator organ, of the wheelwork and of the barrel mounted on the base plate 76 of the autonomous chronograph module MCA. According to the example, in this configuration, the sprung balance 23 ensemble is dimensioned to oscillate at a frequency of 360,000 oscillations per hour.

In the formula:

$$f = \frac{1}{2\Pi}\sqrt{\frac{M}{I}}$$

It is observed that for a given balance-spring, the frequency is inversely proportional to the square root of the moment of inertia of the balance whose formula can be assimilated to that of a hollow cylinder:

$$I = \frac{1}{2}m(R^2 + r^2)$$

where:

$$m = \Pi h\rho(R^2 - r^2)$$

$$I = \frac{1}{2}\Pi h\rho(R^4 - r^4)$$

which leads to:

$$f = \frac{1}{2\Pi}\sqrt{\frac{M}{\frac{1}{2}\Pi h\rho(R^4 - r^4)}}$$

| | |
|---|---|
| f | Frequency [Hz] |
| M | Elastic torque of the balance-spring [Nm] |
| I | Moment of inertia of the balance [kg · m$^2$] |
| R | Outer radius of the balance [m] |
| r | Inner radius of the balance [m] |
| h | Thickness of the balance [m] |
| p | Specific weight of the balance [kg/m$^3$] |

By introducing values for f, R and r in this function, it will be observed that if the frequency is increased for example from 28,800 to 360,000, the diameter of the balance can be divided by approximately five. Experience shows that a balance that is too small does not ensure a good running stability and gives rise to regulating problems. The solution therefore consists in adopting a compromise between a reduction of the balance's outer diameter, which makes it easier to integrate it in the autonomous chronograph module MCA, and an increase of the balance-spring's accelerating power as defined by its CGS number.

In view of these observations, a balance-spring will thus be chosen having technical characteristics allowing a balance to be chosen with dimensions such that the regulator oscillates at the predetermined frequency, that the regulator organ offers good regulating quality and that the balance can be efficiently restarted by the blade-spring 38.

A pallet 113 and an escape wheel 58 can be seen in FIG. 4; these elements can be chosen from existing supplies. According to an embodiment of the device described by way of example, a wheel 59, driven on the staff of the escape wheel 58, is chosen so that it turns at a speed of 2.5 turns per second, the balance 23 oscillating according to the example at 50 Hz (i.e. 360,000 oscillations per hour). A wheel 60 of the hundredth of second train turns clockwise at a speed of one turn per second. A wheel (not visible in the figure because it is hidden by the heart-piece 51), united with the wheel 60, is mounted on the staff 61 of the hundredth of second train and meshes with a wheel 62 driven on a pinion 63, the latter meshing with a wheel 64. A wheel 65 of the seconds train turns clockwise at a speed of one turn per minute thanks to a reverser 66 that connects it to the wheel 64. A wheel 84 (represented in FIG. 5), hidden by the heart-piece 50 and united with the wheel 65, is mounted on the staff 67 of the seconds train. This wheel 84 meshes with a wheel 68 driven on a staff united with a wheel 69 that drives a wheel 70 mounted on the staff 71 of the minutes train. The wheel 70 turns clockwise at a speed of one turn in thirty minutes, it meshes with a wheel 72 driven on a staff 73 united with a wheel 74 that meshes with a toothed transmission-wheel 75 of the barrel 22, with the latter unwinding clockwise under the action of the barrel spring (not represented) at a speed of one turn in 29.7 minutes.

In a mechanical movement, the barrel spring is generally calculated to perform about 7.5 turns. According to the described embodiment, for reasons of limiting the space requirements, the barrel spring is dimensioned to enable the barrel to perform approximately six turns, which equals a power-reserve of 178.2 minutes. But as explained above, use of a regulator organ whose sprung balance ensemble oscillating at high frequency (360,000 oscillations per hour) reduces use of the motor torque of the barrel spring to the period during which the function Δ motor torque/Δ time is linear, means that the useful power-reserve of the autonomous chronograph module MCA is on the order of hundred and twenty minutes (see FIG. 12).

During a measurement with a usual mechanical chronograph, the wheelwork of the chronograph part must be uncoupled from the wheelwork of the horological part. In order to prevent the chronograph hands from floating, it is indispensable to immobilize the wheels of the mobiles carrying said hands. With the autonomous mechanical chronograph module MCA according to the invention, this immobilizing operation is not necessary, since—as has emerged from the above description of the wheelwork of the autonomous chronograph module MCA—the gear-train remains permanently constrained by the barrel spring due to the fact that there is no uncoupling system and that on all the mobiles carrying several wheels (for example the wheels 84 and 65 of the seconds train or even the escape wheel 58 and the wheel 59 mounted on the same staff), the latter are united with one another. These characteristics guarantee a permanent rate-resumption of the train-gears.

Furthermore, on a usual chronograph, the operation of uncoupling the wheelwork of the chronograph part from the wheelwork of the horological part (base movement MB or intermediate wheels of the base movement situated in the chronograph module), and/or of uncoupling these wheelworks from one another, causes jumps, in particular during starting up of the chronograph, which can distort the measurement by several tenths of seconds. This defect is avoided by the present invention. To effect the resetting to zero of the counter hands mounted on the staffs 61, 67 and 71 (FIG. 4), the latter are mounted on their respective trains with a known friction system (for example, by an elastic washer, by indenting, etc.).

As compared with a mechanical chronograph comprising an additional usual chronograph module in which the wheelwork and the arrangement of the counters can be modified, the present invention further gives the possibility of modifying the frequency of oscillation of the balance-spring, the measurement resolution and the power-reserve of the autonomous chronograph module MCA. Generally, the frequency of oscillation supplied by the regulator of the autonomous chronograph module MCA is equal to N times the frequency of oscillation supplied by the regulator organ of the base movement MB; for example, for a base movement of a frequency of 28,800 oscillations per hour, N can be chosen at 12.50, so that the autonomous chronograph module MCA beats the hundredth of second. These characteristics allow the realization of a practically unlimited range of products in all the sectors and commercial niches, from the chronograph watches for the general public to those of top-of-the-range watch-making, up to products reserved for professional use.

Figure 5:
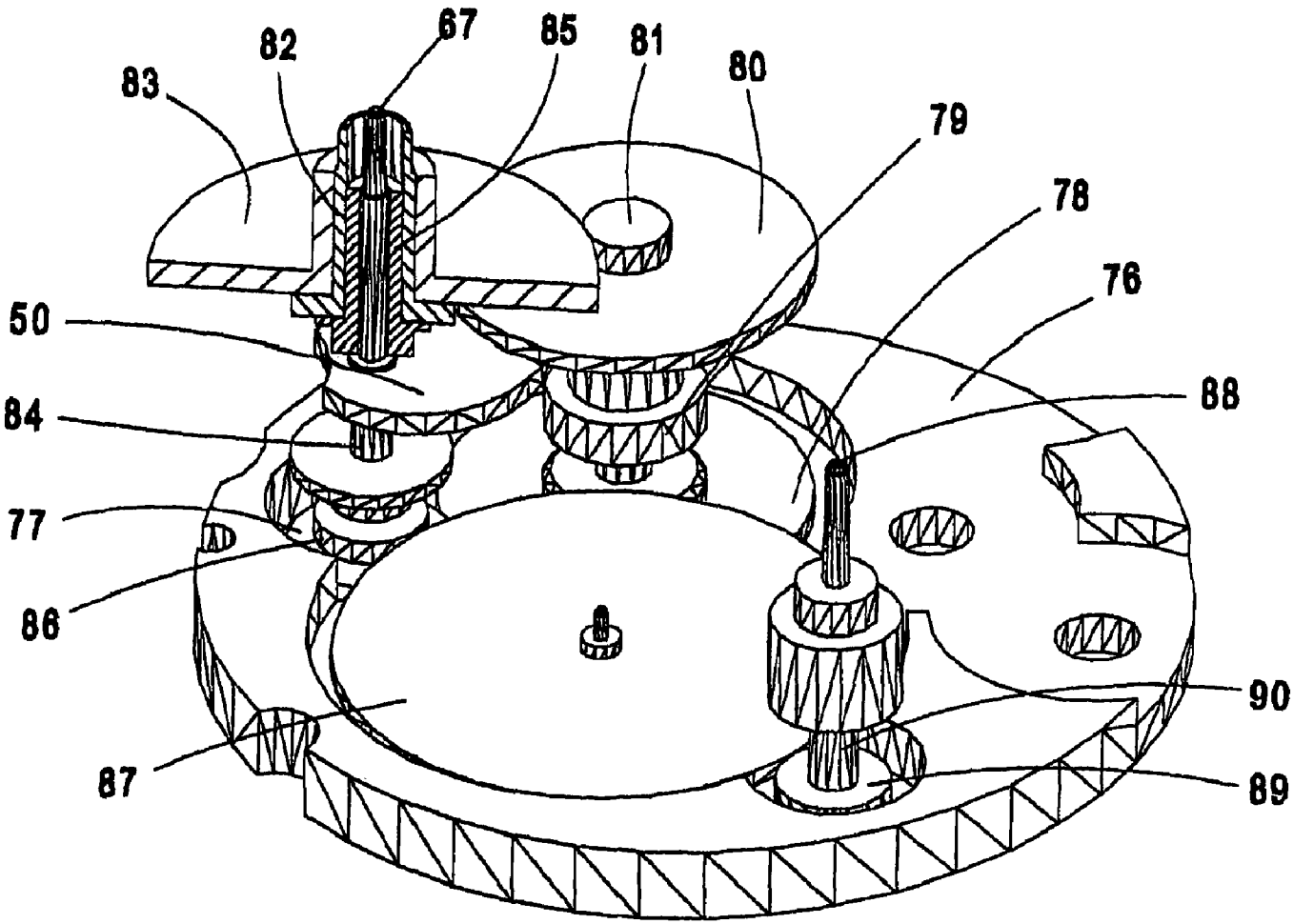
FIG. 5 shows a perspective view of a motion-work and small seconds hand gear system of the chronograph module.

FIG. 5 illustrates one of the many ways of transferring the time indications supplied by the base movement MB through the autonomous chronograph module MCA to the time hands 4, 5 and 6 placed on the dial 14 (FIG. 1).

The wheel 77 mounted on the cannon-pinion of the base movement MB meshes with an intermediate wheel 78 driven on a staff 79 united with the intermediate wheels 80, 81. The intermediate wheel 80 drives a cannon-pinion 82 carrying the minutes hand 5 and mounted freely on a tube 85, with the intermediate wheel 81 driving an hour-wheel 83 carrying the hours hand 4.

A wheel 86 mounted on the seconds staff of the base movement MB meshes with an intermediate wheel 87 that drives a wheel 89 driven on a staff of the small seconds hand 88 placed at three o'clock. To avoid floating of the small seconds hand 6, a wire spring (not represented) can press inside a groove 90 of the staff 88 of the small seconds hand.

This design makes it possible to arrange—according to a current practice—the staff 67 of the trotteuse (direct-drive seconds-hand) 9 of the chronograph in the centre of the MCA module (see also FIG. 4) and offers the user a display of the time interval measured by the autonomous chronograph module MCA.

Figure 8:
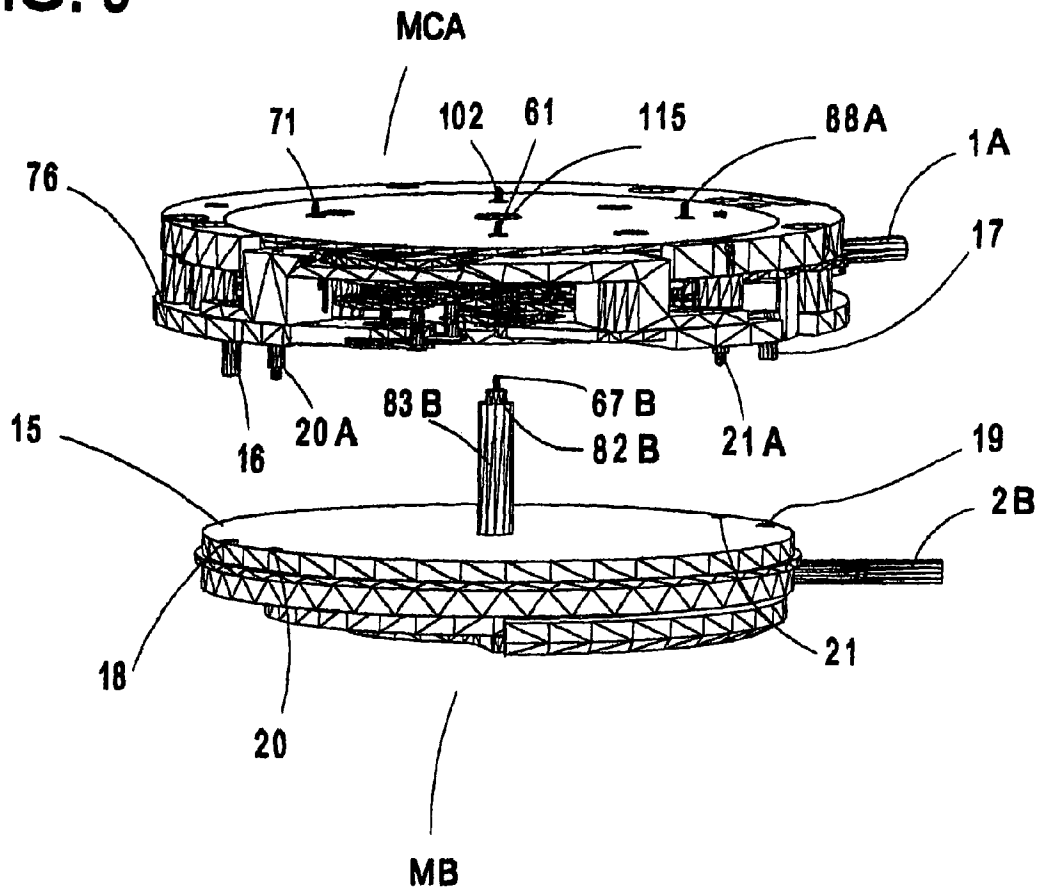
FIG. 8 shows a variant embodiment of the example of embodiment represented in FIGS. 1 to 7.

It is obvious that other designs can easily be conceived. Thus, FIG. 8 (comparable to FIG. 2) represents a variant embodiment according to which a seconds staff 67B, a cannon-pinion 82B and an hour-wheel 83B of the base movement MB have been extended so as to go through a central opening 115 of the autonomous chronograph module MCA and to display the hour, minute and second in the centre of the dial 14. According to this embodiment, the seconds hand of the autonomous chronograph movement MCA is borne by a staff 88A placed at three o'clock on a counter.

Figure 6:
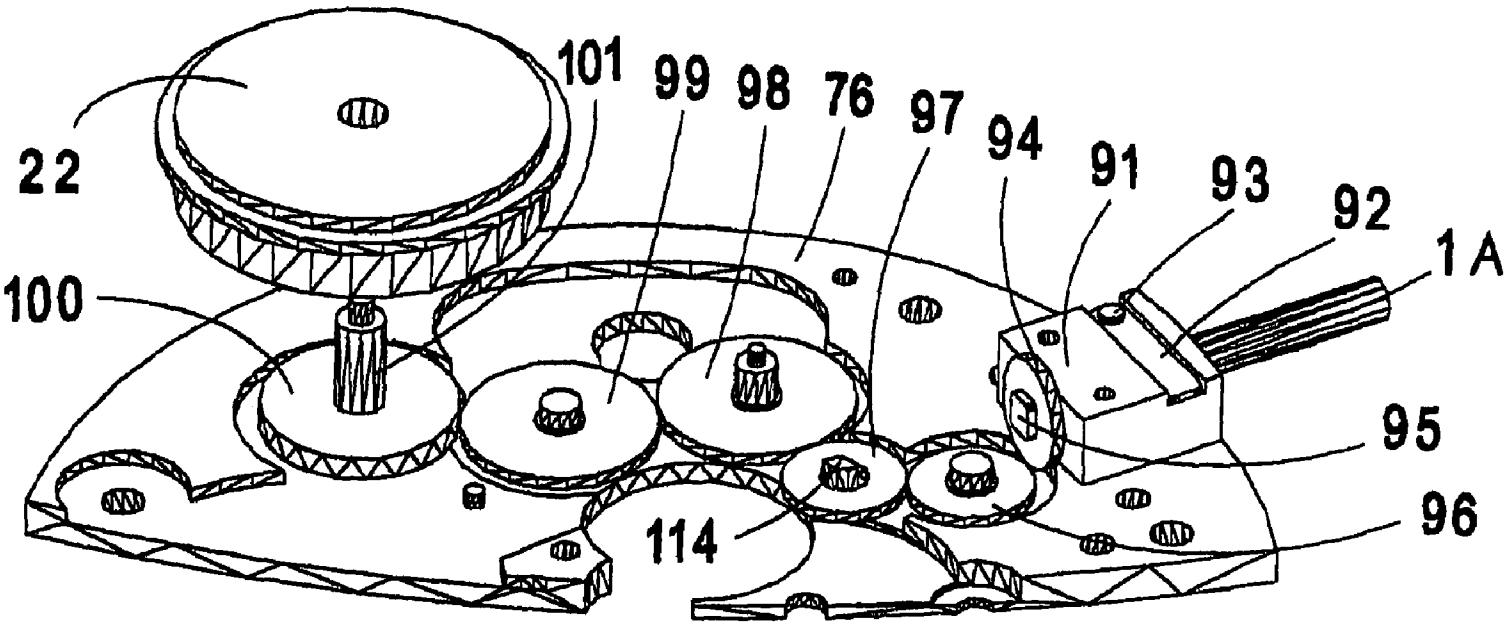
FIG. 6 shows a perspective view of a winding system of the chronograph module.

FIG. 6 is a perspective representation of the winding system of the autonomous chronograph module MCA mounted on the base plate 76. The manual winding of the barrel 22 is performed by rotating the push-piece stem 1A, in resting position, in the same clockwise direction than that required for manually winding the basic mechanical movement MB, necessary for restarting the latter when it has not been worn during a sufficiently long period and the barrel spring is totally unwound (automatic movement). The push-piece stem 1A is guided by a block 91 and held in place by a spring-blade 92. A pressure exerted from below on the extremity of a catch 93 frees the push-piece stem 1A and makes it possible to remove the movement from its case represented in FIG. 1 and not referenced, provided that the same operation is effected on the winding-crown stem 2B (not represented in this Figure).

A bevel-wheel 94 actuated by a driving square 95 of the push-piece stem 1A drives an intermediate wheel 96 meshing with a coupling wheel 97. This wheel 97 is engaged with an intermediate wheel 98 if it turns anti-clockwise around its staff 114, or uncoupled from this intermediate wheel 98 if it turns clockwise, the staff 114 being truncated in amygdaline shape. The intermediate wheel 98 driven by the coupling wheel 97, when it turns anti-clockwise, meshes with an intermediate wheel 99 actuating a ratchet 100 mounted on a core 101 of the barrel 22. The winding of the barrel spring is thus effected by rotating the ratchet 100 clockwise (the clicking system required for conserving the energy stored by the barrel spring during winding, known by the one skilled in the art, is not represented).

Figure 7:
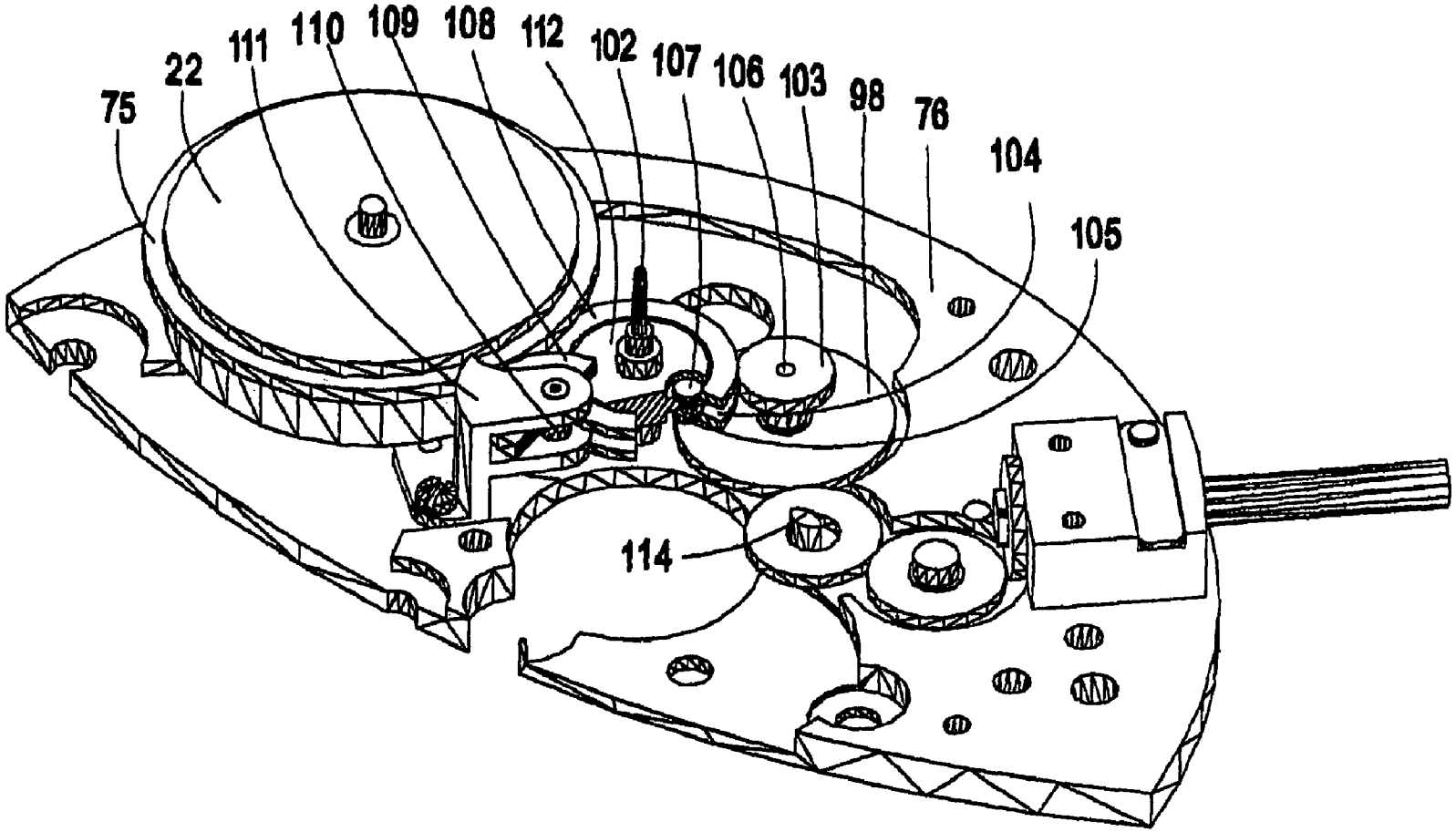
FIG. 7 shows a perspective view of a power reserve of the chronograph module.

FIG. 7 represents in perspective an embodiment of a power reserve device of the autonomous chronograph module MCA, the information relating to the power reserve being displayed at noon on the dial 14 by the hand 12 (FIG. 1). According to the embodiment, it is necessary that one turn of the ratchet 100 (FIG. 6) during winding causes an angular displacement of a staff 102 of power reserve around its axis, equal to and in opposite direction to that generated by one turn of the transmission-wheel 75 of the barrel 22 on the same staff 102 during operation of the autonomous chronograph module MCA. During winding, the ratchet 100 and the wheel 98 driven on the staff 106 turn at the same speed and in the same direction (clockwise), one wheel 103 united with a staff 106 meshes with an outer teething of a sun crown 104, the inner teething of the sun crown 104 drives a planetary wheel 105, the wheel 105 being united with a planetary wheel 107 pressing on an inner teething of a sun crown 108 for making the staff 102 of the power reserve turn anti-clockwise by an angle of 30,375 degrees per turn of the ratchet 100.

When the autonomous chronograph MCA is running, the transmission-wheel 75 of the barrel 22 drives a wheel 109, this wheel 109 being united with a pinion 110 and held by a set-bridge 111. The pinion 110 meshes with an outer teething of the sun crown 108, the inner teething of the sun crown 108 drives the planetary wheel 107 united with the planetary wheel 105 pressing on the inner teething of the sun crown 104 for making the staff 102 of the power reserve turn clockwise by an angle of 30,375 degrees per turn of the transmission-wheel 75 of the barrel 22.

According to this embodiment, the power reserve of the autonomous chronograph module MCA is approximately hundred and twenty minutes, the barrel 22 completes one turn in 29.7 minutes, with one turn of the barrel 22 corresponding to a rotation by 30,375 degrees of the staff 102 of the power reserve. The approximate power reserve of the autonomous chronograph module MCA thus corresponds to an angle of rotation of 127.72 degrees of the power reserve's staff 102.

In order to guarantee that the winding or running of the autonomous chronograph module MCA does not give rise to an unwinding of the barrel spring beyond the limits defined above, a safety device limiting the rotation of the power reserve staff 102 can be provided; this device (not represented) can consist for example of driving a banking-pin in a hole provided on a planetary disc 112, this pin working with an oblong opening concentric with the axis of the staff 102 and provided on a mechanism-cover.

Figure 9:
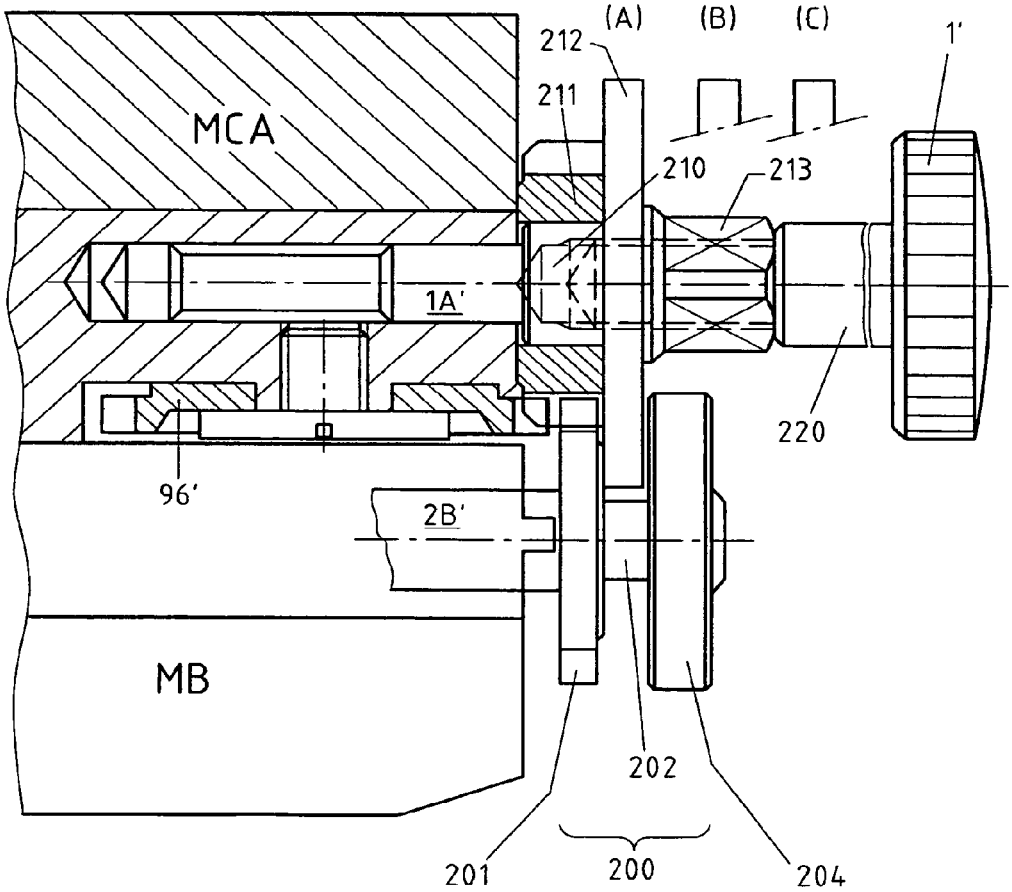
FIG. 9 is a cross-section view of the reset and rewind device in several parts.

FIG. 9 illustrates a preferred embodiment of the invention in which a single winding-crown 1', preferably positioned at 3 o'clock, allows to act both on the base movement MB than on the additional module MCA. For this purpose, the stem 2B' of the base module MB is modified by the adjunction of a knob having a teething 201 and a groove 202. The threading on the stem, which usually allows the external winding-crown 2 to be fastened, is however eliminated.

The stem 1A' of the additional module is provided with a threaded blind hole into which the stem 220 of the winding-crown 1' is screwed. A square 213 on the stem 220 allows the winding-crown 1' to be fastened to esp. disunited from the stem 1A' by means of an appropriate tool. In a variant embodiment, the winding-crown 1' could be fastened directly on the stem 1A'. A winding-crown pinion 211 is unitedly mounted on the stem of the auxiliary module MCA. In position (A), i.e. when the winding-crown 1' is completely pushed axially against the watch case, this pinion 211 engages both with an intermediate wheel 96' of the gear-train for rewinding the barrel 22 and with the teething 201 of the assembly 200 on the stem 2B'.

In the illustrated example, the radius of the pinion 211 is dictated by the distance between the axis of the stem 1A' and the plane of the intermediate wheel 96'. The engaging ratio between the pinion 211 and the teething 201 is thus imposed by the thickness of the base movement and of the additional module. It can be useful to choose a number of turns and the torque to be applied on the winding-crown to rewind or reset the base module. In practice, it is for example comfortable to use an engaging ratio equal to one, making it possible to rewind and reset the base movement with the optimal number of turns and torque initially devised for this movement. In a variant embodiment not illustrated, the pinion 211 can thus be replaced by two side-by-side pinions of different diameters engaging one with the intermediate wheel 96', the other with the teething 201.

The intermediate wheel 96' on which the pinion 211 engages is chosen so as to enable to wind the base movement MB by actuating the winding-crown 1' in a first rotational direction, and to rewind the auxiliary module MCA by actuating this winding-crown in the other rotational direction, which allows these two elements to be rewound independently. In a variant embodiment, it could be considered more convenient to engage the rewinding pinion 211 with an intermediate wheel 96' chosen so that the movement MB and the module MCA are both rewound by actuating the winding-crown in the same direction. In such an embodiment, an engaging ratio between the pinion 211 and the teething 201 different from one could be chosen in order to reduce the torque necessary for rewinding the two modules simultaneously.

In a variant embodiment not illustrated, in order to avoid inverting the rotational direction of the winding-crown 1' during rewinding of the base movement MB, a middle intermediate wheel could be provided between the pinion 211 and the teething 201.

By pulling the winding-crown 1' outwards, the collar 212 drives the stem 2B' of the base movement MB outwards through the intermediary of the shoulder 204. The one skilled in the art will understand that the collar 212 and the assembly 200 can be inverted on the two axes 1A' and 2B'.

In the example illustrated, the reset mechanism of the base movement MB forces the stem 2B' to adopt predetermined axial positions, and thus the collar 212 to adopt one of the three indexed axial positions (A), (B) or (C).

In the positions (B) and (C), the pinion 211 does not engage any longer with the intermediate wheel 96' but only with the teething 201 of the assembly 200 which is displaced outwards. In position (B), the winding-crown 1' enables to rapidly correct the indicator 250 (FIG. 10) of the base movement. In position 3, the winding-crown 1' allows the resetting of the base movement.

An optional pivot, not represented, could be mounted in the prolongation of the stem 2B' to reduce the risk of flexion or rupture of this stem. This pivot could pivot in a bearing (not illustrated) worked in the inner face of the watch-case.

Figure 10:
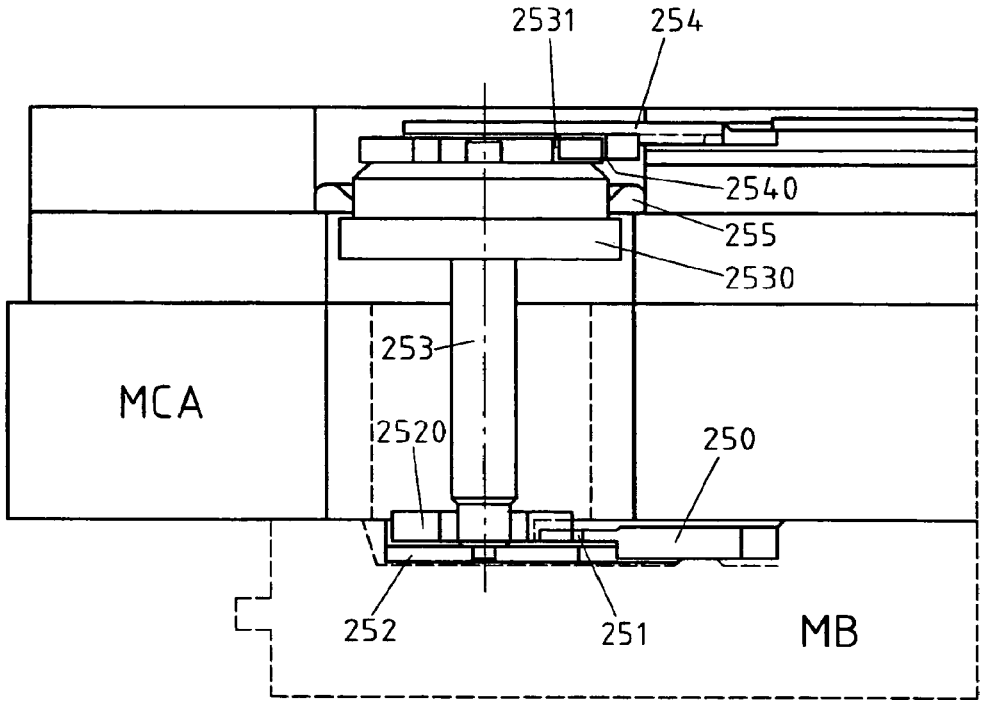
FIG. 10 is a cross-section view of the date correction transmission device from the base movement towards the auxiliary module.

FIG. 10 is a cross-sectional view of the date correction transmission device from the indicator disc 250 of the base movement towards the date disc 254 of the auxiliary module. The date disc 254 of the auxiliary module MCA carries the date indications seen by the watch's wearer.

As indicated here above, the winding-crown 1' pulled in position B enables to correct, e.g. to manually advance, the angular position of the disc 250 of the base movement MB through the intermediary of the pinion 211, of the teething 201 and of the stem 2B'. According to the invention, the disc 250, as opposed to the usual date discs, is disengaged from the gear-train of the base movement, for example by removing the day disc; the disc 250 is thus not driven by the base movement, which allows the power necessary to drive it to be saved and thus the power-reserve of the watch to be increased.

The disc 250 is held by a ring 252 connected or screwed to the auxiliary chronograph module MCA. A pinion 2520 mounted on a shaft 253 works with a teething 251 on the outside of the disc 250, so that the date corrections on the disc 250 are transmitted to the ring 252 and then to the shaft 253 traversing the auxiliary chronograph module MCA. The shaft 253 is held free to pivot in the movement by a jewel or a bearing 255, a shoulder 2530 preventing the shaft from coming out through the top of the figure.

A pinion 2531 mounted at the upper extremity of the shaft 253 engages with a teething 2540 connected with a second date disc 254 on the upper side of the auxiliary module MCA. This date disc is driven by the auxiliary module MCA, through the intermediary of a day disc not represented. The upper side of the date disk 254 carries date indications visible for the watch bearer through an opening in the face, these known elements having not been represented. Thus, the date disc 254 is driven and regulated by the high-resolution auxiliary module MCA but can be corrected through the base movement MB by acting on the winding-crown 1'.

In the variant embodiment illustrated in FIG. 10, the shaft 253 and the disc 250 of the base module (not visible from outside the watch) are driven in rotation by the date disc 254. This thus causes an unnecessary movement of parts and an energy loss. In a variant embodiment not represented, the gear constituted by the teething 2540 and the pinion 2532 is replaced by a free coupling, of a type known by the one skilled in the art, permitting only to transmit the correction movements transmitted from the shaft 253 towards the upper date disc 254, but not the rotations in opposite direction.

Figure 11:
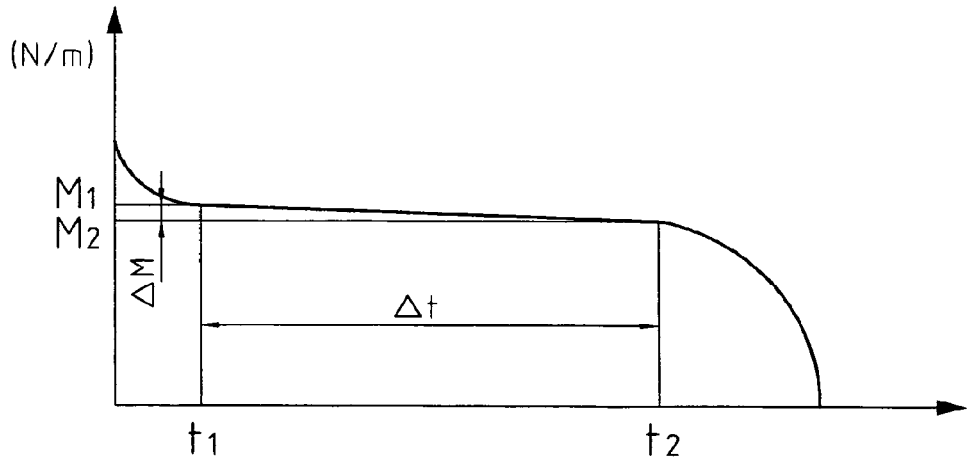
FIG. 11 is a diagram indicating the torque of the barrel spring necessary to guarantee a given power-reserve.

It will be understood that it is also possible, within the framework of the invention, to correct the indication of the upper date disc directly by means of the reset stem 1A' of the auxiliary module, without using the correction mechanism of the base movement MB. The solution illustrated in FIG. 11 has however the advantage of using the date correction mechanism frequently available on the base movement and thus to avoid duplicating this mechanism in the auxiliary module.

It is obvious that the autonomous chronograph module MCA can be used as such, i.e. not necessarily associated to the base movement MB.

The invention claimed is:

1. A wrist-watch, comprising:

a dial;

a base movement provided with at least one time indicator driven by a first barrel;

a chronograph module provided with at least one indicator, both said indicators being visible on a same side of the wrist-watch;

said chronograph module being exclusively composed of mechanical elements;

said indicator of said chronograph module being driven by a second barrel;

a power reserve indicator organ for indicating on the dial the power reserve of said second barrel said indicator being adapted for indicating to a user the power reserve available for powering a chronograph function of said watch, wherein:

said base movement comprises a first regulator organ connected to a first wheelwork, to said first barrel and to said time indicator of the base movement, said chronograph module comprises a second regulator organ connected to a second wheelwork, to said second barrel and to said indicator of the chronograph movement, the second regulator being constantly engaged with the second wheelwork, the frequency of oscillation supplied by the second regulator being different from the frequency of oscillation supplied by the first regulator.

2. The wrist-watch of claim 1, wherein the frequency of oscillation supplied by the second regulator organ is equal N times the frequency of oscillation supplied by the first regulator organ, the coefficient N being defined in such a way that the chronograph module allows a resolution to the hundredth of second at least.

3. The wrist-watch of claim 2, wherein the coefficient N is at least equal to 12.50, the frequency of the base movement being 28,000 oscillations per hour and the frequency of the chronograph module being at least 360,000 oscillations per hour.

4. The wrist-watch of claim 3, wherein an indicator organ of the chronograph module is mounted on a staff of the hundredth of second counter performing a 360 degrees rotation per second, and wherein said indicator organ is constituted of a hand permitting time intervals of a hundredth of second to be read, by coincidence of said hand with a graduation comprising hundred marks placed on a dial.

5. A wrist-watch, comprising:

a dial;

a base movement provided with at least one time indicator driven by a first barrel;

a chronograph module provided with at least one indicator, both said indicators being visible on a same side of the wrist-watch;

said chronograph module being exclusively composed of mechanical elements;

said indicator of said chronograph module being driven by a second barrel;

a power reserve indicator organ for indicating on the dial the power reserve of said second barrel said indicator being adapted for indicating to a user the power reserve available for powering a chronograph function of said watch, wherein organs of a clock part of the base movement and of the chronograph module are arranged on a single common bottom plate.

6. A wrist-watch, comprising:

a dial;

a base movement provided with at least one time indicator driven by a first barrel;

a chronograph module provided with at least one indicator, both said indicators being visible on a same side of the wrist-watch;

said chronograph module being exclusively composed of mechanical elements;

said indicator of said chronograph module being driven by a second barrel;

a power reserve indicator organ for indicating on the dial the power reserve of said second barrel, wherein:

said base movement comprises a first regulator organ connected to a first wheelwork, to said first barrel and to said time indicator of the base movement, and wherein said chronograph module comprises a second regulator organ connected to a second wheelwork, to said second barrel and to said indicator of the chronograph movement, the second regulator being constantly engaged with the second wheelwork, the frequency of oscillation supplied by the second regulator being different from the frequency of oscillation supplied by the first regulator.

7. The wrist-watch of claim 6, wherein the frequency of oscillation supplied by the second regulator organ is equal N times the frequency of oscillation supplied by the first regulator organ, the coefficient N being defined in such a way that the chronograph module allows a resolution to the hundredth of second at least.

8. The wrist-watch of claim 7, wherein the coefficient N is at least equal to 12.50, the frequency of the base movement being 28,000 oscillations per hour and the frequency of the chronograph module being at least 360,000 oscillations per hour.

9. The wrist-watch of claim 8, wherein an indicator organ of the chronograph module is mounted on a staff of the hundredth of second counter performing a 360 degrees rotation per second, and wherein said indicator organ is constituted of a hand permitting time intervals of a hundredth of second to be read, by coincidence of said hand with a graduation comprising hundred marks placed on a dial.

10. A wrist-watch, comprising:

a dial;

a base movement provided with at least one time indicator driven by a first barrel;

a chronograph module provided with at least one indicator, both said indicators being visible on a same side of the wrist-watch;

said chronograph module being exclusively composed of mechanical elements;

said indicator of said chronograph module being driven by a second barrel; and a power reserve indicator organ for indicating on the dial the power reserve of said second barrel, wherein organs of a clock part of the base movement and of the chronograph module are arranged on a single common bottom plate.

* * * * *